United States Patent [19]

Levin

[11] 4,259,671

[45] Mar. 31, 1981

[54] ANTENNA DEICING APPARATUS

[75] Inventor: Herbert L. Levin, Wyckoff, N.J.

[73] Assignee: RCA Corporation, New York, N.Y.

[21] Appl. No.: 68,090

[22] Filed: Aug. 20, 1979

[51] Int. Cl.[3] ..... H01Q 1/02

[52] U.S. Cl. ..... 343/704

[58] Field of Search ..... 343/704, 840

[56] References Cited

U.S. PATENT DOCUMENTS

| | | | |
|---|---|---|---|
| 2,645,435 | 7/1953 | Pouit | 244/15 |
| 2,658,143 | 11/1953 | Fiet et al. | 343/704 |
| 2,679,003 | 5/1954 | Dyke et al. | 343/704 |
| 2,755,216 | 7/1956 | Lemons | 343/704 |
| 2,760,191 | 8/1956 | Blackmer et al. | 343/704 |
| 3,777,648 | 12/1973 | McGowan et al. | 98/2.04 |
| 3,917,193 | 11/1975 | Runnels | 244/42 |

FOREIGN PATENT DOCUMENTS

| | | | |
|---|---|---|---|
| 863223 | 1/1953 | Fed. Rep. of Germany | 343/704 |
| 2035211 | 7/1970 | Fed. Rep. of Germany | 343/704 |

*Primary Examiner*—Eli Lieberman

*Attorney, Agent, or Firm*—Samuel Cohen; William Squire

[57] ABSTRACT

A parabolic radiation reflecting sheet member of an antenna is covered over a lower half portion of its convex side with a spaced sheet member which forms a manifold chamber with the reflecting sheet member. An upper edge of the manifold lies along a parabolic line along the midsection of the convex side of the antenna. A single hot air inlet conduit is attached to the manifold adjacent a lower edge and centrally of the antenna. A plurality of spaced hot air exhaust ports are positioned on the manifold upper edge and are each individually settable to control the flow of hot air from the inlet to the exhaust ports. The exhaust ports have a restricted aperture area to provide a pressure head in the chamber causing hot air to flow throughout the manifold chamber heating substantially all of the lower half portion of the reflecting sheet member.

8 Claims, 7 Drawing Figures

ANTENNA DEICING APPARATUS

Figure 1:
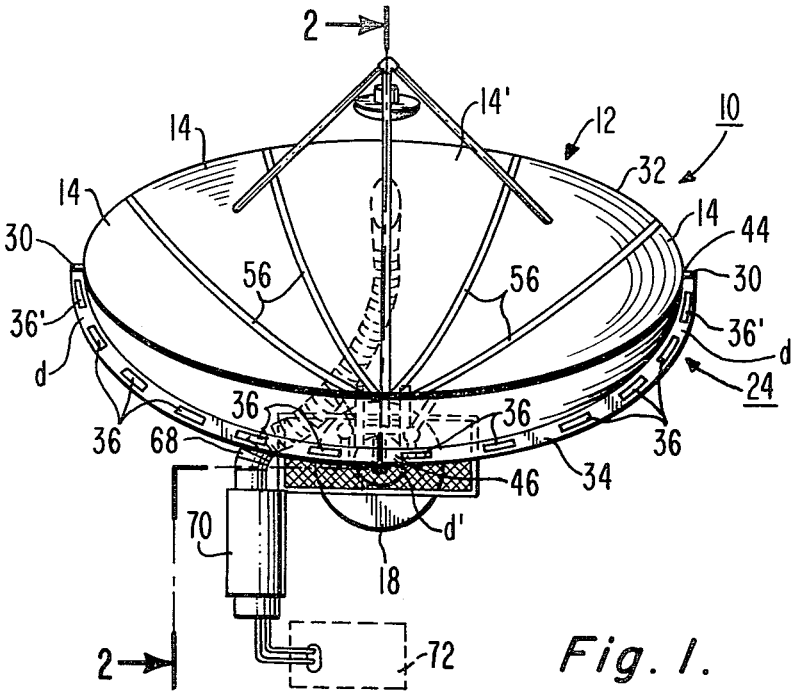

The present invention relates to a system for heating the reflector of an antenna for preventing any substantial accumulation of ice and snow thereon.

Communications antennas are in wide use for receiving and transmitting electrical waves such as those in the microwave frequency range. Such antennas, of the type of interest here, include a reflector, such as one of the parabolic type, for producing a highly directive beam pattern. The reflector may be in the order of 30 to 40 or more feet in diameter.

When such an antenna is used outdoors, it is exposed to rain, sleet and snow, and this precipitation reaches at least a portion of the surface of its reflector. During freezing temperatures, the precipitation reaching the reflecting surface can adhere thereto in the form of ice or snow and this is undesirable because the increased loading on the antenna sometimes can damage the same and does increase the load on the antenna drive mechanism, and because the electrical properties of the antenna can be adversely affected. In temperature ranges of slightly below or slightly above freezing, snow tends to be especially adherent and is particularly troublesome to the operation of such an antenna.

Systems for deicing antennas such as described are in wide use. One such system uses electrical resistor elements in an insulating blanket attached to the reflecting surface on the back side thereof and powered by electrical energy from conventional utility lines. Such a system is relatively expensive to install and on a typical large diameter antenna of the type discussed above, consumes relatively large amounts of power, results in penalty costs for intermittent power surge requirements and requires expensive utility lines not otherwise needed and which are especially costly in the case of remote installations. Further, in the cases in which it is necessary to retrofit an antenna already in the field, it is the usual practice to dismantle the antenna and ship it to a factory for installation of the heating elements there. The antenna must then be reshipped to its original site and reassembled. This is time consuming and expensive, and is also undesirable because the antennas are out of service for a considerable time period.

It is possible to install the resistance heating blankets in the field but this requires removal of the paint and careful preparation and cleaning of the back side of the reflecting surface to approximate the factory environmentally controlled conditions that will insure a good bond. This field installation is time consuming and costly.

Other systems which are more inefficient can be used in times of emergency. In these other systems, antifreeze solutions are continuously sprayed over the antenna to prevent the formation of ice and snow on the antenna surface.

A deicing apparatus embodying the invention includes a sheet member secured to the back-surface of the antenna reflector and forming a manifold chamber therewith. Heated air is supplied to this chamber. A plurality of adjustable spaced exhaust port means permit the exit of air from the chamber and control the paths of hot air flow through the chamber such that the desired heating of the reflector occurs to reduce any tendency for snow or ice build-up. The air in the manifold chamber is maintained at a higher pressure than the ambient atmosphere to enhance the flow of heated air along desired flow paths through the chamber.

Figure 2:
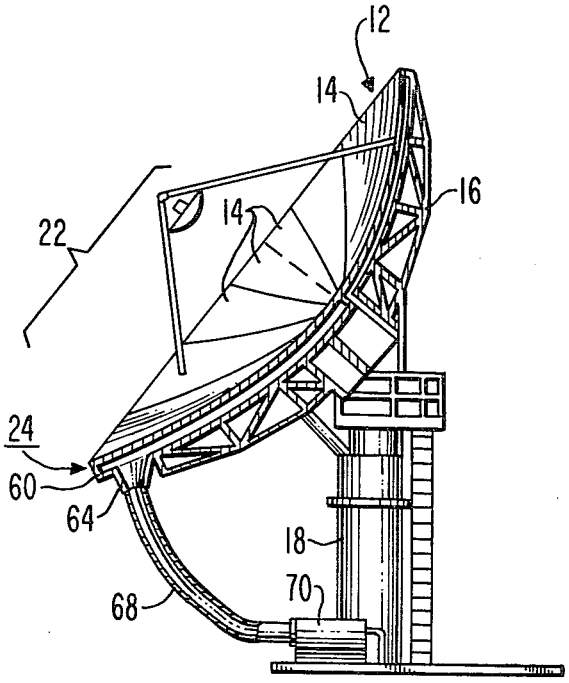
Figure 3:
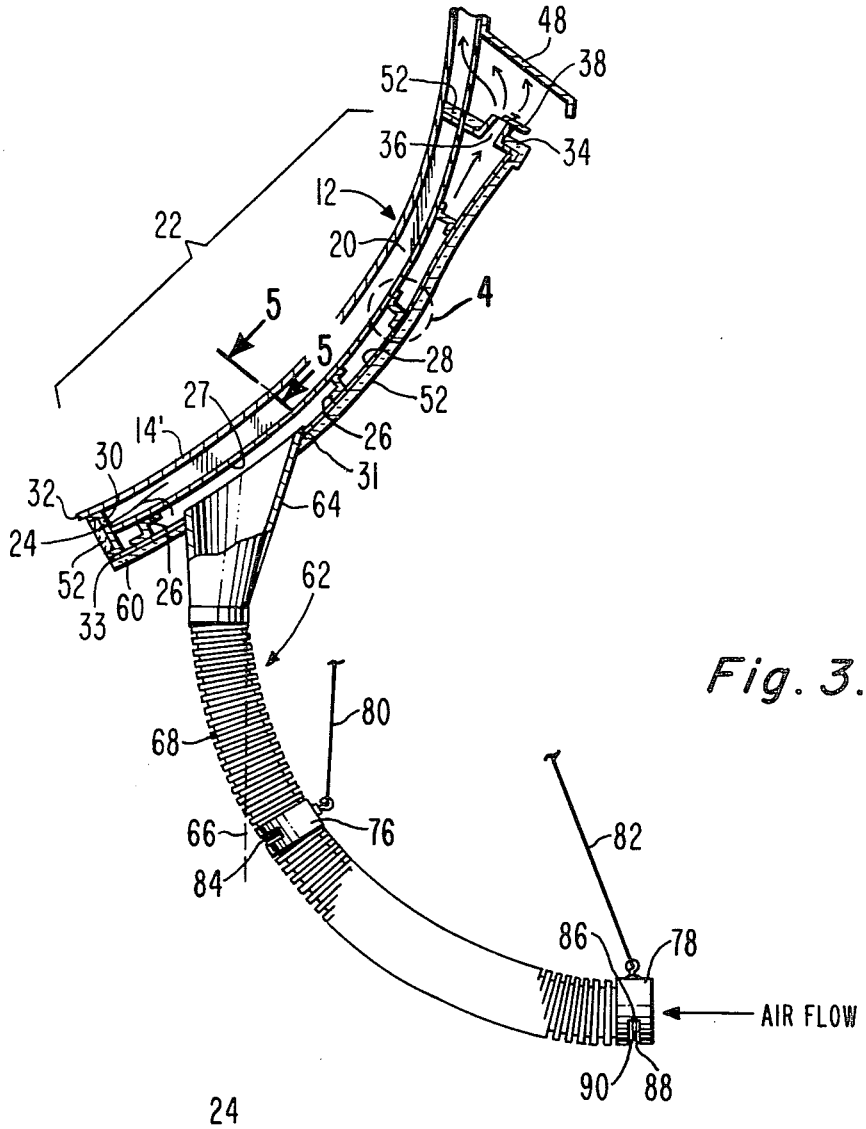
Figure 4:
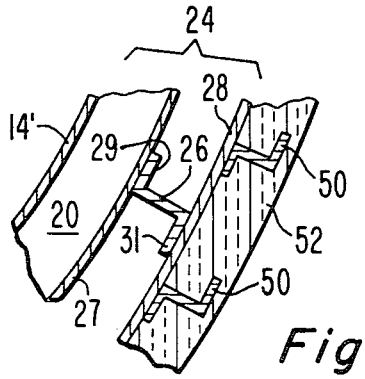
Figure 5:
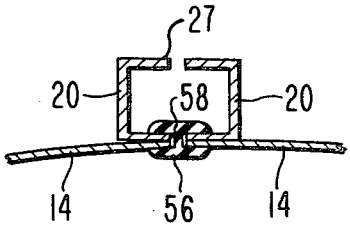
Figure 6:
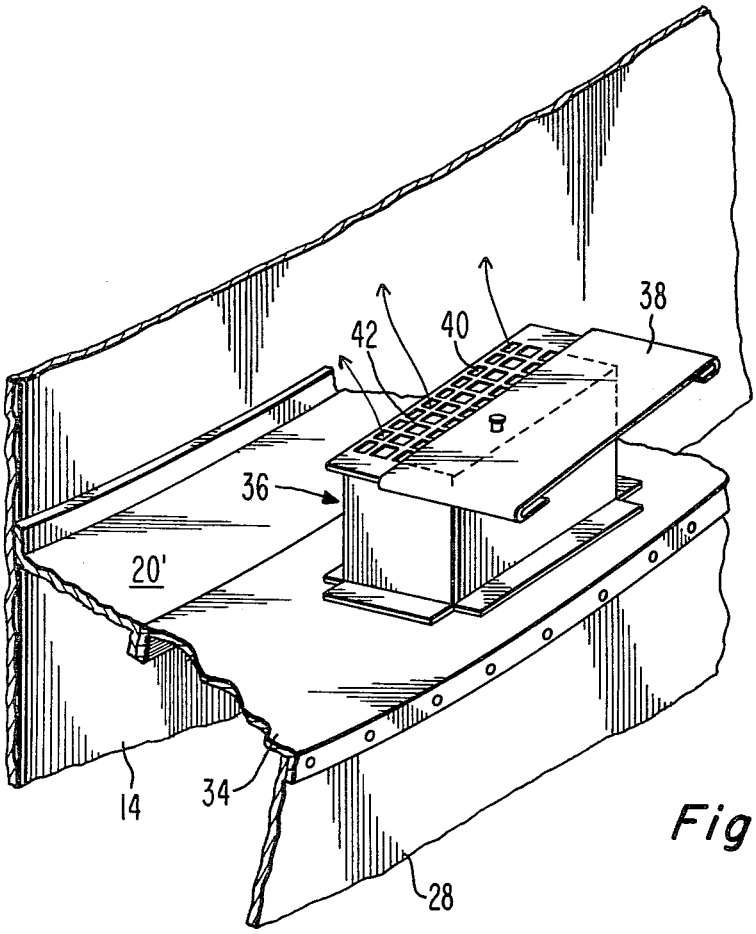
Figure 7:
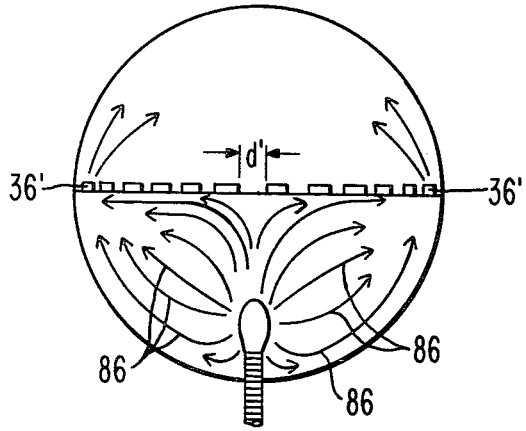

In the drawing:

FIG. 1 is a plan view of an antenna construction embodying the present invention, FIG. 2 is a side elevation partial sectional view taken along lines 2—2 of FIG. 1, FIG. 3 is a sectional view of a portion of FIG. 2 illustrating the heating manifold chamber in more detail, FIG. 4 is a sectional view of a portion of the section of FIG. 3 enclosed by the dashed circle 4, FIG. 5 is an end view of a portion of the section of FIG. 3 taken along lines 5—5, FIG. 6 is a prospective view of one of the settable discharge ports of FIG. 1, and FIG. 7 is a rear view schematic flow diagram illustrating the air flow as determined by the setting of the discharge ports.

In FIG. 1 the antenna 10 illustrated by way of example is a parabolic antenna used for microwaves and in one practical design, it is 43 feet in diameter. Antenna 10 includes a reflecting dish 12 which is formed of a plurality of curved, triangularly shaped metal sheets, each forming a segment 14 of the dish. The segments 14 are connected together and supported by a connecting framework 16 (FIG. 2). Segments 14 are formed of like thickness sheet metal—0.08 inches thick aluminum in one practical design. The segments may be riveted or spot welded to aluminum ribs such as rib 20, FIGS. 3 and 5, to form triangular assemblies which are bolted together to form the antenna dish 12. The segments 14 are spaced from one another at their edges and gaskets 56, of H shaped cross-section (FIGS. 1 and 5) are over these edges, as discussed later. In FIG. 3 a segment 14' is shown mounted to a rib 20. The ribs 20 extend radially from the dish center and in the cut-away view of FIG. 3 one such rib 20 is shown extending from the upper right around the curve to the lower left. There are a number of ribs 20 and cross ribs 20' (FIG. 6) which secure each of the segments 14 and 14' in place. The dish 12 and its framework 16 are supported on a pedestal 18 (FIG. 2) and may be rotated through restricted sectors about the azimuth and vertical axes by suitable mechanisms (not shown).

The antenna for which the present deicing system is particularly useful is one in which the beam reflected or transmitted is at an angle in the range of about 0° to 50° with the horizontal. With such angles, the lower half 22 of the concave portion of the dish 12 (FIG. 2) tends to retain ice and snow thereon. It is desirable, therefore, with this particular antenna that at least this area be especially deiced. The heating system of the present application including manifold 24 provides such deicing as discussed below.

Referring to FIGS. 3 and 4, manifold 24 is formed by fastening a plurality of Z-shaped standoffs 26 over the outer surfaces 27 of the ribs 20. One leg 29 of the Z is secured to surface 27. The other leg 31 is parallel to surface 27. The standoffs 26 are spaced from one another along the length of each rib 20 as illustrated schematically in FIG. 3. Mounted to the outer surfaces of legs 31 of the standoffs 26 is a sheet 28, preferably of a light material such as aluminum. Sheet 28 may be formed in segments and riveted, welded or otherwise fastened to the legs 31 of the standoffs 26 to form a continuous manifold wall which is substantially uniformly spaced from the segments 14.

The outer edges 32 of the antenna segments 14 coinciding with the outer edges 33 of sheet 28 are connected to rim member 30 to enclose the manifold 24 chamber. The rim member 30 is circular and extends adjacent the circular edge 32 of the segments 14 (FIG. 3).

Enclosing the upper edge of the manifold 24 is exhaust port mounting member 34, FIGS. 3 and 6. The foam layer 52 over 28 and 34, discussed later is not shown in FIG. 6. Mounting member 34 is a U-shaped channel metal sheet member which lies in substantially one plane which curves around the parabolic outer convex surface of the dish 12. Member 34 which extends, along a parabolic curve passing across roughly about the mid-section of the antenna dish, encloses the manifold 26 at its upper end.

Attached to the mounting member 34 are a plurality of air exhaust ducts 36, one of which is shown in FIG. 6. The ducts 36 may be identical and are preferably rectangular conduits extending above the rim member 34. Each of the ducts is fitted with a sliding cover 38 which opens and closes the exhaust ports 40 of the duct. The exhaust ports 40 are aimed at the upper backside portion of the dish 12. A screen 42 is placed over the opening to prevent foreign matter from entering into the manifold 24 chamber. The cover 38 may completely close or completely open the port 40 or may be positioned anywhere between these two extreme positions. Those ducts 36 nearest the left and right edges 44 of the antenna (FIG. 1) are spaced closer together than those nearest the antenna center at 46.

For example, on a 43 foot diameter (about 48 feet along the parabola) antenna dish, ducts 36 may be 4 inches by 12 inches in area. The ducts 36' (FIG. 1) closest to the dish outer edges are spaced about ½ foot from the dish outer edge. The next inner duct is spaced distanced about 2 feet from the outer duct. The spacing increases from this 2 foot value by about ½ foot thereafter until a spacing of 4 feet is reached between the fifth and sixth ducts from the outer edges. The two central ducts are separated by a distance d' of (FIG. 7) about 6 feet. The ports 40 may be opened and closed independently of each other. Over each duct 36 is a hot air deflector 48 (FIG. 3) which also serves as a shield against rain and snow.

Mounted on the outer surface of the sheet 28 (FIG. 4) are a plurality of Z-shaped elements 50. Over this outer surface of sheet member 28 and the Z-shaped elements 50 is sprayed an insulating polyurethane foam layer 52 for thermally insulating the outer surface of the chamber formed by manifold 24. The elements 50 serve to mechanically retain the foam to the sheet member 28 and to act as depth indications to obtain a uniform foam thickness. The entire outer surface of the manifold 24 including the rim member 30 and exhaust port mounting member 34 is covered with the insulating layer 52.

In the slots 58 between the spaced segments 14 are air sealing strips 56 (FIGS. 1 and 5). Strips 56 are H-shaped in section and may be formed of rubber, nylon or other suitable material. Strips 56 serve to seal the slots so as to provide an effectively sealed manifold 24 chamber. This prevents the escape of hot air and seepage of water into the plenum chamber. The strips 56 may be slid in place from the outer edges of the antenna dish 12.

Connected near the lower edge 60, FIG. 3, and approximately midway between the extreme right and left edges of the antenna dish 12 is a hot air inlet conduit 62. Conduit 62 includes a funnel 64 which is secured to the sheet member 28. The funnel 64 is positioned approximately vertically with the dish at the angle shown (about 30° with the horizontal) so that the water accumulating within the chamber formed by manifold 24 will drip downward along the dashed line 66. The funnel 64 is extended into manifold 24 and caulked to the inner surface of 28 to serve as a gutter 31 to minimize water flow into conduit 68.

Weep holes may be placed at the lower edge 60 of the manifold 24 to provide drainage for accumulated water within the manifold. A flexible conduit 68 connects the funnel 64 to a hot air furnace and blower 70 (FIG. 2). The furnace and blower 70 is a conventional apparatus connected to an underground fuel supply 72, dashed, FIG. 1. The flexible conduit 68 permits the antenna 10 to be rotated through a restricted elevation section (say 0°–50°) and a restricted azimuth section (about 180°) while maintaining air flow connection between the furnace 70 and manifold 24. Funnel 64 is roughly vertical when the antenna is at the elevation shown to also minimize the strain on corrugated conduit 68 at its connection to the funnel.

Conduit 68 is supported at collars 76 and 78 by support wires 80 and 82 respectively, secured to the framework 16. A slot 84 is formed in the collar 76 and a slot 86 is formed in the collar 78. The slots 84 and 86 serve to drain water accumulated within the conduit 68. Slots 84 and 86 are the same and each has an inwardly bent flange 88 whose inner edge 90 tapers upwardly in the stream direction. Air flows over flange 88 and continues to flow in the conduit. However, water dripping in the opposite direction of the air flow reaching the flange 88 will be diverted by the flange and flow through the slot 86 to the outside of the conduit 68.

The inlet aperture cross section area of the funnel 64 is sufficient to provide the desired flow rate of hot air into the manifold 24. However, it is important that hot air flows across the entire lower portion 22 of the antenna dish 12 to insure the desired heating of all portions of the reflector forming a wall of the manifold, before exiting from the exhaust port 36. This must be done in the presence of ribs 20 which may impede the air flow. For this reason, it is desired that a head pressure be built up within the manifold, which is greater than the ambient atmospheric pressure. The slots 84, 86 are relatively small and little pressure loss occurs here. This pressure head insures a flow of hot air throughout the manifold regardless the orientation of ribs 20. When the established head pressure in the manifold is greater than ambient atmosphere pressure, the hot air flows over the ribs 20 and is then discharged to the ambient atmosphere permitting new hot air flow into the manifold 24 which is a single continuous volume covering the entire backside of portion 22.

Depending on antenna size and location of funnel 64, flow characteristics may vary. For one particular antenna of 43 foot diameter, the end ports 36' were opened and the remaining ports are fully closed. The ports 36' were opened approximately ¾ of the aperture. For this particular antenna, the ports were 4 inches by 12 inches in area. The inlet aperture of the funnel 64 was approximately 16 inches in diameter. The inlet flow rate was approximately 2100 cubic feet per minute at approximately 180° F. for an antenna whose lower half had an area of approximately 850 square feet. The manifold 24 in such an antenna had a volume of approximately 500 cubic feet with the manifold spacing about 7 inches between the reflecting surface and the manifold sheet member 28.

In FIG. 7 the arrows 86 show the approximate flow path of the air from the inlet to the exhaust ports 36'. In essence, the manifold 24 forms a single plenum chamber in which the hot air is distributed substantially throughout the chamber prior to exiting from the chamber through the ports 36'. For antennas of different diameters or different angular inclinations with respect to the earth, it may be necessary to adjust the various ones of the ports 36 to provide sufficient hot air flow to insure the lower half portion is heated for those particular antennas. What is desired is to provide heating to raise the temperature of the lower half portion of the antenna dish above the melting point of ice to prevent ice and snow build up thereon. Blower 70 for supplying hot air to an antenna dish of 43 feet in diameter may have a 350,000 BTU per hour output.

While twelve exhaust ports 36 are illustrated in the present embodiment, more or fewer discharge ports may be provided other antennas in accordance with their sizes. The spacing between the ports in such antennas is determined empirically for providing optimum uniformity of hot air flow within the manifold 24, that is, over the back surface of the lower half of the reflector. It is in this region that the major heating is desired.

The outer surface of the insulating foam 52 may be painted with a weather protecting coating, as needed. Such a coating may provide a weather and moisture sealant as well as provide a fire retardant.

Some deicing is also provided by the washing over the upper half of the antenna by the hot air discharging from the ports 36. However, this effect is much smaller than the primary heating of the lower half of the reflector from within the manifold 24.

When the temperature of the ambient atmosphere is below 28° F., snow falling is usually sufficiently dry that it is blown off the antenna surface by normal wind loads. At this time, no heating of the antenna is required. Above 35° F., no freezing occurs on the antenna surface and no heating is required above this temperature. Within the range of 28° to 35° F., snow falling on the antenna surface is sufficiently wet to be adherent to the surface and may cause an undesirable snow accumulation. It is in this temperature range that the heating system is operated to deice the antenna. It is to be understood that the antenna is deiced while fully exposed to ambient winds and temperature variations on all sides.

While a manifold is shown over the lower half portion of the antenna dish, it may include greater areas in accordance with a particular implementation. For example, if the antenna is pointed straight up (90° elevation angle), it might be desirable in this one to cover the entire back side with a manifold.

What is claimed is:

1. In an antenna construction including a concave radiation reflecting sheet member, said antenna being oriented in use so that at least a portion of said concave sheet member faces toward space away from earth and is receptive to falling snow which may be retained thereon, a deicing apparatus for heating said portion to melt and remove said snow comprising:

a manifold sheet member mounted spaced from the convex side of said reflecting sheet member over about said portion, said manifold sheet member facing and being joined with said convex side to form a single manifold chamber therewith, air inlet means for flowing heated air into said chamber at a single given chamber location, and a plurality of settable spaced port means coupling said chamber to the ambient atmosphere and positioned along an upper edge of the manifold chamber to provide air flow within said chamber over said reflecting sheet member over substantially all said portions, said port means being set at a sufficiently restricted flow area and spaced in a given position with respect to said inlet means flow area to provide an air head pressure within said chamber higher than ambient atmosphere to cause a flow of heated air over substantially all of said portion within said chamber, said chamber having a wall thereof approximately at the mid-section of said concave sheet member extending from one edge of said antenna to an opposite edge, said ports being located in said wall at spaced positions between said edges.

2. The apparatus of claim 1 further including an insulating layer over the outer surface of said manifold sheet member.

3. The apparatus of claim 1 wherein said spaced port means each include opening adjust means for individually opening or closing that port means.

4. The apparatus of claim 1 wherein the spacing between adjacent ports decreases as the distance between said ports and the next adjacent edge increases.

5. The apparatus of claim 1 wherein said reflecting sheet member includes a plurality of spaced sheets forming an effective radiation reflecting surface with a plurality of slots between adjacent sheets, further including slot sealing strips in said slots to thereby form a substantially closed wall of said chamber with said reflecting sheets.

6. The apparatus of claim 1 wherein said inlet means are at a lower portion of said reflecting sheet member approximately centrally positioned between the antenna edges lying on a vertical line passing through the antenna center.

7. The apparatus of claim 1 wherein said inlet means includes flexible conduit means with a water drain aperture.

8. The apparatus of claim 1 wherein said port means includes first and second ports located at spaced positions along a chamber wall, said positions being closer to an edge of said reflecting sheet member than its center.

* * * * *